US006118103A

United States Patent [19]

Vilato et al.

[11] Patent Number: 6,118,103

[45] Date of Patent: Sep. 12, 2000

[54] GLASS-CERAMIC PLATE CONTAINING A TACTILE MARKING RELIEF

[75] Inventors: Pablo Vilato, Paris; Michel Grassi, La Ferte sous Jouarre, both of France

[73] Assignee: Eurokera, F-Chateau Thierry, France

[21] Appl. No.: 09/233,187

[22] Filed: Jan. 20, 1999

[30] Foreign Application Priority Data

Jan. 20, 1998 [FR] France ..... 98 00537

[51] Int. Cl.[7] ..... H05B 3/68

[52] U.S. Cl. ..... 219/443.1; 219/446.1; 219/448.11

[58] Field of Search ..... 219/445.1, 446.1, 219/451.1, 452.11, 457.1, 458.1, 460.1; 126/211, 217, 214 A

[56] References Cited

U.S. PATENT DOCUMENTS

| | | | |
|---|---|---|---|
| 5,155,338 | 10/1992 | Hoffman | 219/445.1 |
| 5,432,320 | 7/1995 | Scheidler et al. | 219/445.1 |
| 5,528,015 | 6/1996 | Von Blanquet et al. | 219/445.1 |
| 5,958,272 | 9/1999 | Taplan et al. | 219/518 |

*Primary Examiner*—Sang Paik

*Attorney, Agent, or Firm*—Oblon, Spivak, McClelland, Maier & Neustadt, P.C.

[57] ABSTRACT

A glass-ceramic plate containing at least one heating element associated with at least one control element. The plate is provided with a relief in the form of bumps and/or recesses of dimensions permitting tactile identification of the control element. A process for manufacture of this glass-ceramic plate including shaping by settling, molding or pressing of the relief.

31 Claims, 3 Drawing Sheets

GLASS-CERAMIC PLATE CONTAINING A TACTILE MARKING RELIEF

BACKGROUND OF THE INVENTION

1. Field of the Invention

The invention relates to glass-ceramic plates designed to cover heating elements. More precisely, the invention is directed toward glass-ceramic plates which constitute part of cooking tops. Such cooking tops are provided in particular with heating elements such as heat sources of radiant or halogen-lamp type and with control and regulation means allowing the power thereof to be varied.

2. Discussion of the Background

For such control and regulation means there are commonly employed knobs fixed on spindles passing through holes in the glass-ceramic plate. This solution is not entirely satisfactory. In the first place, the provision of holes in the plate, under conditions which preserve sufficient mechanical strength thereof while limiting manufacturing defects and therefore the proportion of rejected products, necessitates the use of complex processes. In the second place, such an embodiment of the control means does not permit complete cleaning of the plate, because regardless of the leaktightness of the interface between the knob and plate, the peripheral rim of the knob necessarily forms a sharp edge or defines a slit, which inevitably will attract and possibly trap dust, small crumbs, etc.

One solution consists in replacing the classical control knobs by sensing keys in accordance with the teaching of European Patent Application EP 0443924 A1. The control and regulation means for a cooking or warming means comprises, especially as described in that document, a pair of keys, one of which is used to increase the power delivered to the associated heat source each time the user's finger makes contact with this key, while the other is used to reduce the power of this same heat source in steps. According to an alternative, there can be provided a plurality of keys corresponding to distinct heating powers. In order to define precisely the positioning of the keys and their allocations to the different heat sources, the document suggests forming marks on the top surface of the glass plate by a silk-screen or other process. It thus involves a basically visual mark; in fact, although screen-printed patterns stand out very slightly (for example, by 4 $\mu$m at most) from the plane of the plate and constitute a differentiated surface condition thereof, they do not permit uniquely tactile marking of the control means and of the manner in which they can be used, even by an experienced person, blind or otherwise.

In addition, screen-printed marks are not desirable with regard to cleaning the plate. They actually have a tendency to retain dust and to be progressively destroyed under the abrasive action of the cloth or sponge and by chemical attack due to the cleaning product.

As a remedy, European Patent Application EP 0464323 A2 proposes, for marking the contours of the heating zones on a glass-ceramic plate, replacing the screen-printed patterns by bands of parallel recessed grooves on the surface of the plate. Such a mark has the advantage of being almost indelible, and is designed in particular to be unaffected by repeated sliding movements of various utensils (pans, casserole dishes, etc.) thereabove. Such marks permit visual marking. However, tactile marking, for example for a blind user, is not described in EP 0464323, presumably because it would be unsafe in view of the close proximity of the cooking or warming means and the risk inherent therein.

SUMMARY OF THE INVENTION

The object of the invention is therefore to provide a glass-ceramic plate in which the control zone of the cooking or warming elements does not necessitate an additional complex working stage (provision of holes, shaping, etc.), but ensures easy marking, particularly of tactile nature for a blind user, of the control means.

Consequently, the object of the invention is a glass-ceramic plate containing one or more heating elements, for example cooking or warming elements, and one or more associated control elements. More precisely, the invention consists in the fact that the glass-ceramic plate has relief (i.e. a textured surface) in the form of bumps and/or recesses of dimensions such that it permits tactile marking of a specified zone and/or function of the plate. Relief according to the invention can be achieved without the necessity of employing a specific additional stage In the process of manufacture of the glass-ceramic plate: at the very most it will be necessary to adapt the geometry of the support or of the molding or pressing surfaces to which the plate must conform, and which ordinarily are plane. Furthermore, tactile marking capability is easily achieved by judicious choice of the relief geometry. Another advantage, additionally achieved by virtue of the invention, is the almost indestructible and indelible character of the relief despite the multiple mechanical impacts and chemical attacks to which it may be subjected.

In order to guarantee tactile marking under the best conditions, the height of the relief is at least equal to 15 $\mu$m and preferably 0.2 mm, the latter value being easily achieved in reproducible manner by classical molding processes. By relief "height" within the meaning of this embodiment, it is understood its dimension in the direction perpendicular to the plane of the plate, or as otherwise commonly described the difference in level between its highest and lowest points. Advantageously, this height does not exceed 50 mm; a greater height would in fact be pointless and even detrimental for reasons of ergonomics, overall dimensions and difficulty of the forming process.

According to a particularly advantageous embodiment of the invention, the area around the marking relief on the plate has a substantially smooth surface condition, whose relief constitutes a continuous variation. The control zone is then free of grooves, enameled (screenprinted, etc.) lines and of any sharp raised or recessed edge that could be snagged and possibly chipped or otherwise affected, especially by a cooking utensil, or that could trap dust in such a way that it could be removed only with difficulty by cleaning.

Advantageously, the substantially smooth surface condition eliminates the problem of progressive abrasion of screen-printed patterns, minimizes the risk of chipping after a mechanical impact and permits complete cleaning of the control zone.

Another object of the invention comprises a cooking appliance containing a glass-ceramic plate such as described hereinabove.

Yet another object of the invention is a process for manufacture of this glass-ceramic plate. This process specifically comprises shaping of the plate by a settling, molding or pressing operation, with use of a support or of molding or pressing surfaces having the desired geometry, especially in their portion corresponding to the control zone of the plate.

Settling, molding or pressing can be performed at any time during a classical process of manufacture of a glass-ceramic plate, provided that the material of which it is made is at a sufficiently high temperature to permit plastic deformation. Such a classical process is described in French Patent FR 2657079, the contents of which are incorporated herein by reference.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1C:
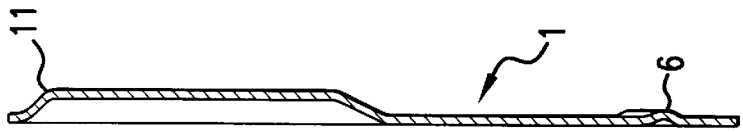
FIG. 1C is a sectional view of this plate along the axis 1C—1C.
Figure 1B:
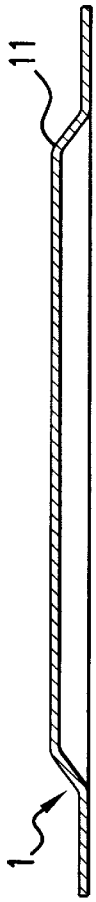
FIG. 1B is a sectional view of this plate along the axis 1B—1B.
Figure 1A:
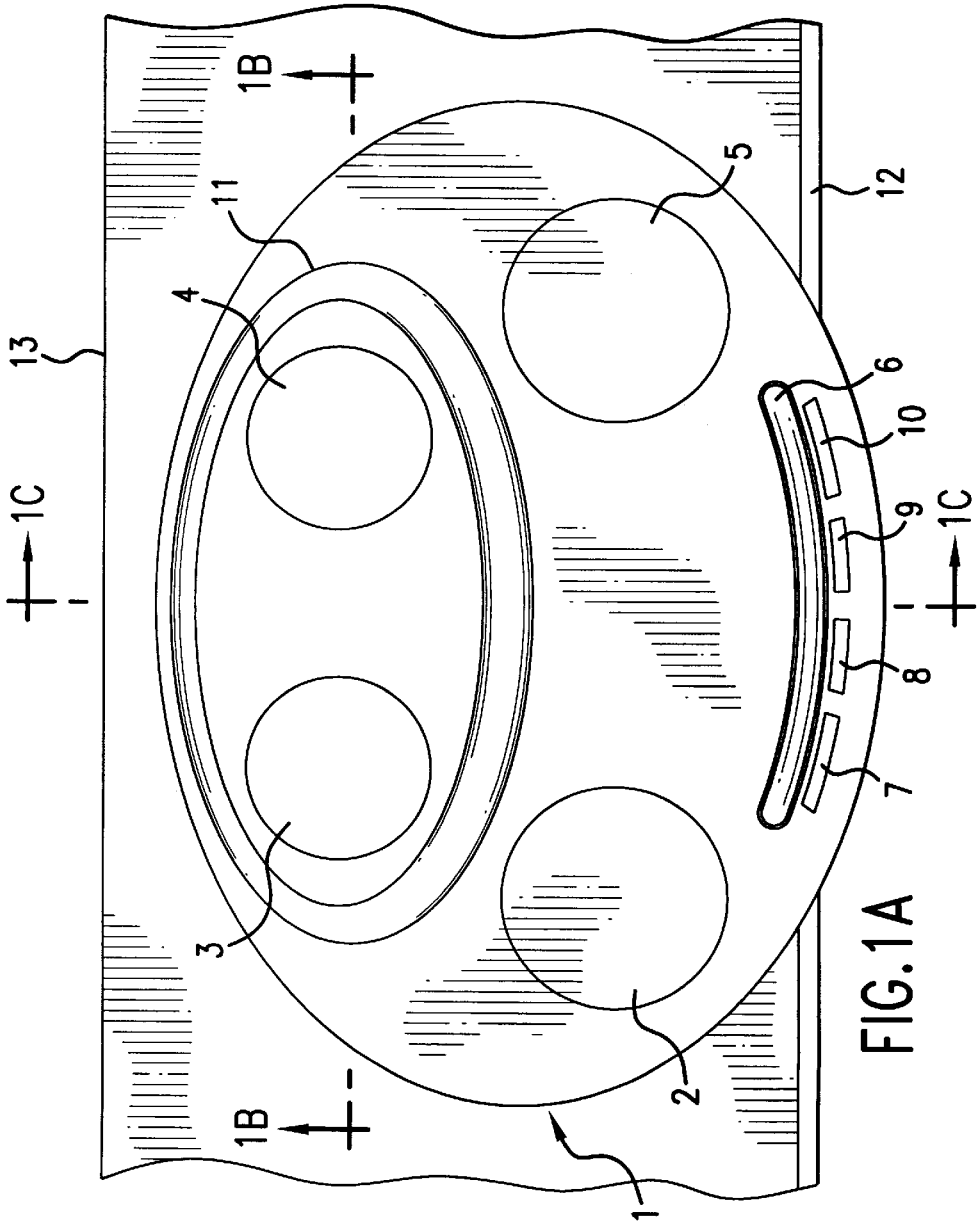
FIG. 1A is a top view of a glass-ceramic plate according to the invention.

Referring to FIGS. 1A, 1B and 1C, the glass-ceramic plate 1, with classical thickness and constituent material known in the prior art, has four cooking heat sources 2, 3, 4 and 5. It is immaterial whether these heat sources are of radiant, halogen-lamp or induction type. Also, one of the cooking heat sources can be a gas burner installed in an opening made in the plate, as described, for example, in European Patent Application EP 0715125 A1.

The plate 1 is provided on the front portion of its top surface with raised relief 6 having the form of a transverse segment. For esthetic purposes, and also in the interests of rational use of the surface of the plate, this segment conforms to the slight curvature of the front rim thereof. As shown in FIG. 1C, the relief 6 does not have any sharp edges. The relief 6 permits sensitive marking of the control zone for heat sources 2, 3, 4 and 5. Sensing keys 7, 8, 9 and 10 for control and regulation of heat sources 2, 3, 4 and 5 respectively are disposed immediately in front of and along the relief 6, from left to right in FIG. 1A or in other words matching the arrangement of the heat sources to which they are allocated. The substantially linear form of the keys 7, 8, 9, 10 and of the relief 6 proves particularly suitable for selection of heating power, which is determined as a function of the position of the finger on the key or of the distance travailed by the finger on the key.

In this embodiment, the relief is therefore positioned close to the control elements 7, 8, 9 and 10, which in addition are defined by screen-printed marking on the plate.

According to a preferred variant of the invention, it would also be conceivable to dispense with this screen-printed marking in order to endow the control zone with a basically smooth surface in the sense indicated hereinabove. A way to eliminate the need for the screenprinted marking consists, for example, in forming the relief 6 as individualizable elements, each associated with at most one control element, especially as clearly identifiable elements allocated to each of the cooking heat sources to ensure control and regulation thereof For example, it is possible to envision creating discontinuities in the relief 6 opposite the interstices separating the sensing keys 7 and 8, 8 and 9, and 10. Control of a heat source is exercised at the position of the appropriate sensing key, not provided with marking by enameled lines, more precisely in front of and in the immediate proximity of the appropriate element of the relief 6.

According to another embodiment, the relief 6 coincides with one or more control elements. Again, relief 6 can be formed as individualizable relief elements, which coincide, for example, very simply with the sensing keys 7, 8, 9 and 10 of FIG. 1A, in which case the screen-printed marking becomes superfluous.

Figure 5:
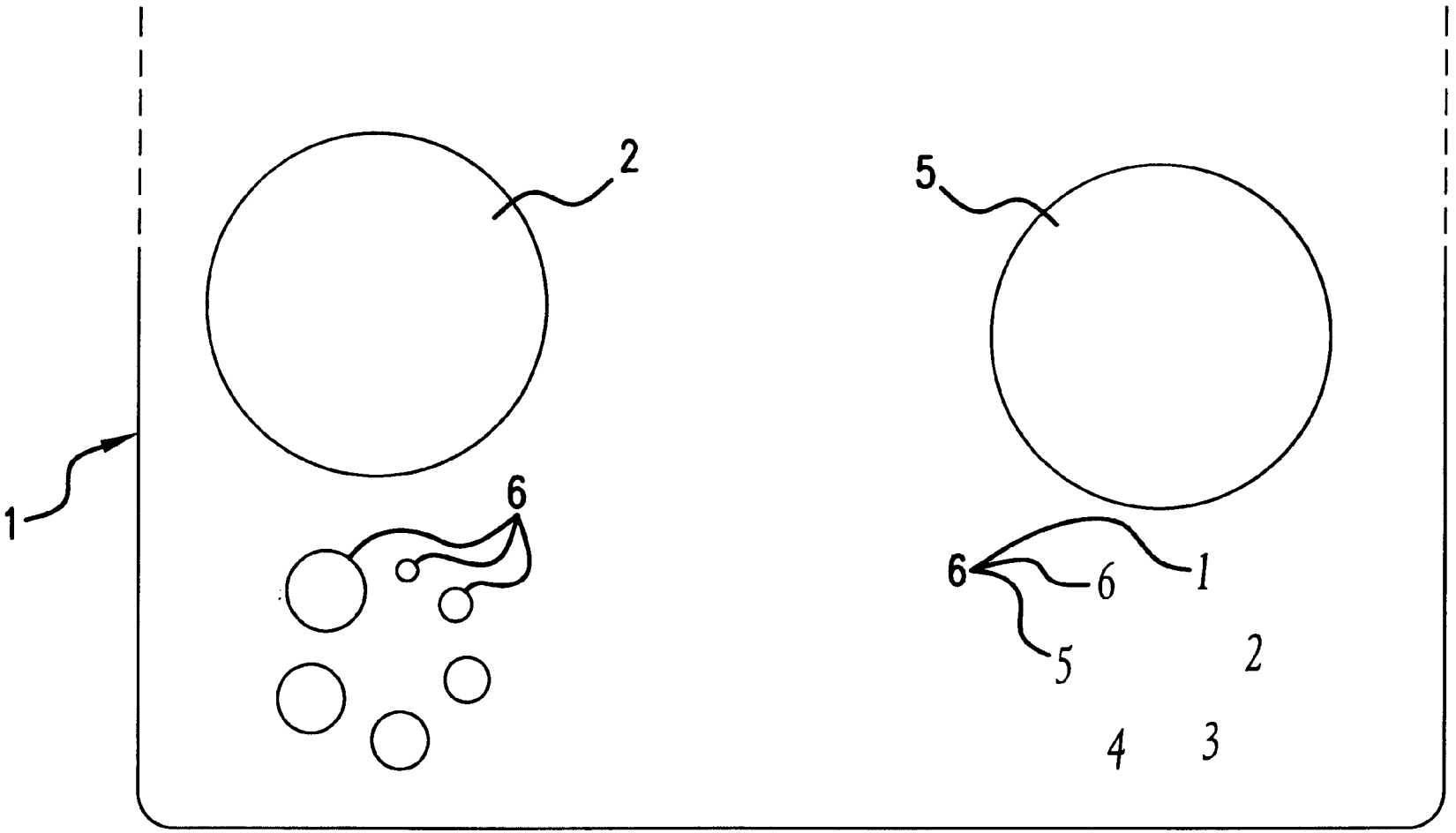
FIG. 5 is a top view of examples of relief element according to the present invention.

Other practical kinds of relief 6 can be envisioned for the control means. There can be conveniently provided relief elements whose relative positions match those of the different cooking heat sources; these relief elements are used to designate the cooking heat source being controlled. To select the heating power, a classical circular arrangement of powers increasing in clockwise direction may prove convenient. Each power level can be marked by a number in relief or by a geometric pattern of proportionally increasing size as shown in FIG. 5. Moreover, other geometric shapes such as square, rectangular, triangular, circular, oval, polygonal, concave or convex, regular or otherwise, with rounded, almost linear or pointed slope, can be employed to form the marking relief During forming of the relief 6, a ridge 11 surrounding cooking heat sources 3 and 4 was created in the same way. The ridge 11 does not contain any sharp edge, and thus permits easy and complete cleaning.

The creation of the ridge satisfies concerns of esthetic and also practical nature. Thus, according to one variant, each of the cooking heat sources is provided with its own individual ridge of the plate, all of these ridges being separated from each other by a portion of the top surface of the plate having lower height. Any liquid which escapes from the cooking vessel will flow over this lower portion, thus avoiding the surface of the plate corresponding to the cooking heat sources themselves, where the maximum temperatures can be reached. Thus liquid which has escaped is prevented from being transformed by heating to a solid and adhering deposit; cleaning of the plate is facilitated. In addition, the ridge of zone 11 of the rear cooking heat sources 3 and 4 minimizes the effort required to deposit the cooking vessels on these heat sources or to retrieve them therefrom, by moving them above other vessels which may be disposed on one of the front heat sources 2 and 5.

Furthermore, at least one portion of the relief 6 can comprise a relief element, connecting at least one of the control means 7, 8, 9, 10 to the cooking or warming means 2, 3, 4, 5 associated therewith. This connecting relief element may be a recessed channel in the plate or a raised segment of equivalent form. The connecting relief element can itself be a control element of the sensing key type, the selected heating power then being advantageously proportional to the length of the channel or raised segment of equivalent form traveled by contact of a finger. In other words, the connecting relief element is configured to allow control of said at least one heating element by contact with said relief element.

Another variant concerns the case of a modular glass-ceramic plate, i.e. comprising an assembly of elemental portions of any shapes, which can be identical or different (triangular, rectangular, square, arcs of circles, etc.). According to this variant, which is particularly easy to make, a portion of the relief 6 is disposed between the rims of the neighboring elemental portions of the plate; this portion of the relief 6 constitutes or comprises, as the case may be, sensing control keys for the cooking heat sources.

The plate 1 is framed in known manner in a working plane, the front and rear rims 12 and 13 respectively of which are shown.

Figure 2:
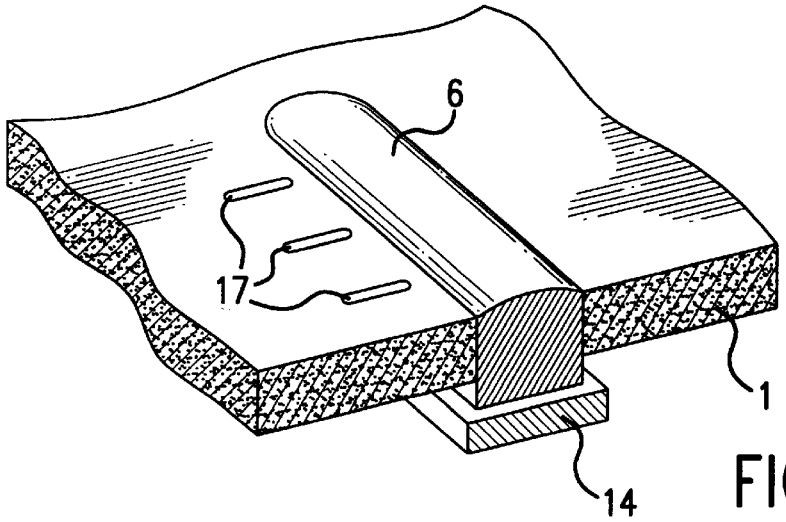
FIGS. 2, 3 and 4 are partial schematic perspective views of different practical examples of relief according to the invention.
Figure 3:
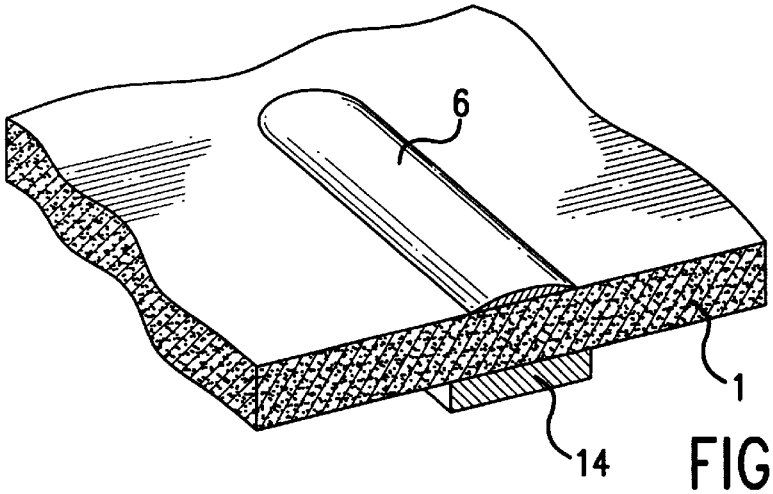
Figure 4:
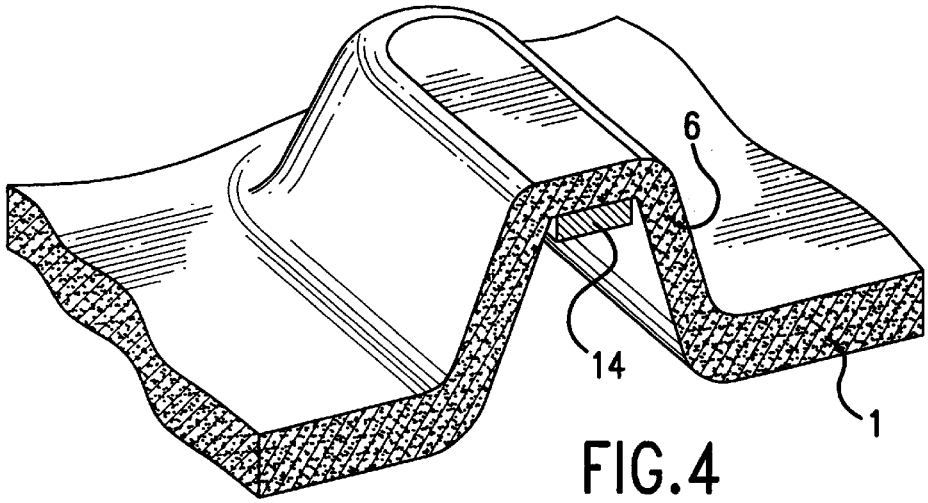

On each of FIGS. 2, 3 and 4, there are shown a glass-ceramic plate 1, a sensing control key for one or more cooking or warming elements provided on a control surface in relief 6, and a capacitive element 14.

As shown in FIG. 2, the relief 6 is formed by the emergent portion of an insert lodged in a recess cut completely through a peripheral zone of the plate 1. According to another embodiment, the insert could be positioned between the neighboring rims of two elemental modules constituting the plate. The insert is either metallic or of plastic material, or preferably of a glazing material such as glass ceramic. It may be made integral with plate 1 by gluing, thermal coalescence of glazing material, etc., depending on the constituent material thereof.

Screen-printed patterns 17 are marks for the selected power levels.

According to the variant of FIG. 3, the relief 6 comprises an element simply joined to the plate 1. This element is made from the same group of materials as those of the insert mentioned hereinabove; it is made integral with plate 1.

According to another embodiment shown in FIG. 4, the relief 6 is formed from the constituent material of the glass-ceramic plate 1 itself, especially by settling, molding or pressing as mentioned hereinabove.

Consequently, the glass-ceramic plate of the invention facilitates maintenance of complete cleanness; the means of marking the control elements, comprising relief in the material of the plate or in another material, offers optimal resistance to mechanical impacts and chemical attacks. Furthermore, the formation of the disclosed glass-ceramic plate can be integrated into the classical process of manufacture of glass ceramic plates without requiring additional cost. All control operations and manipulations relating to this plate are made possible without the use of any visual approach, by virtue of the integral tactile marking concept employed.

Obviously, numerous modifications and variations of the present invention are possible in light of the above teachings. It is therefore to be understood that within the scope of the appended claims, the invention may be practiced otherwise than as specifically described herein.

This application is filed based on French Patent Application No. 98/00537 filed Jan. 20, 1998 and incorporated herein as reference.

What is claimed is:

1. A glass-ceramic plate having a top surface, comprising:

at least one heating element;

at least one control element configured to control said at least one heating element;

a relief defined by said top surface and comprising at least one member of the group consisting of a bump in said top surface and a recess in said top surface, said relief having dimensions permitting tactile identification of the control element.

2. A glass-ceramic plate according to claim 1, wherein the relief has a height of at least 15 $\mu$m.

3. A glass-ceramic plate according to claim 2, wherein the relief has a height of at least to 0.2 mm.

4. A glass-ceramic plate according to claim 1, wherein the relief has a height less than 50 mm.

5. A glass-ceramic plate according to claim 1, further comprising a smooth continuous transition between the relief and an area of plate surrounding the relief.

6. A glass-ceramic plate according to claim 1, wherein each of the relief elements comprises an element joined to the plate.

7. A glass-ceramic plate according to claim 1, wherein the relief comprises a plurality of relief elements corresponding to a plurality of control elements, said relief elements being arranged so as to match an arrangement of a plurality of heating elements corresponding to said plurality of control elements.

8. A glass-ceramic plate according to claim 1, wherein the relief comprises a relief element connecting said at least one control element to said at least one heating element.

9. A glass-ceramic plate according to claim 8, wherein the connecting relief element is configured to allow control of said at least one heating element by contact with said relief element.

10. A glass-ceramic plate according to claim 1, wherein said at least one control element comprises a sensing key.

11. A glass-ceramic plate according to claim 10, wherein the sensing key has a substantially linear shape permitting control of a power level for said at least one heating element.

12. A glass-ceramic plate, comprising:

at least one heating element;

at least one control element configured to control said at least one heating element;

a relief comprising at least one member of the group consisting of a bump and a recess, said relief having dimensions permitting tactile identification of the control element, wherein the relief comprises a plurality of relief elements corresponding to a plurality of power levels for said at least one heating element, said relief elements having different characteristics from one another so as to allow identification of the power levels.

13. A glass-ceramic plate according to claim 12, wherein each of the relief elements comprises a same material as the glass-ceramic plate.

14. A glass-ceramic plate according to claim 12, wherein the plurality of relief elements have different geometric shapes from each other.

15. A glass-ceramic plate according to claim 12, wherein the plurality of relief elements have different heights from each other.

16. A cooking appliance including a glass-ceramic plate having a top surface, comprising:

at least one heating element;

at least one control element configured to control said at least one heating element;

a relief defined by said top surface and comprising at least one member of the group consisting of a bump in said top surface and a recess in said top surface, said relief having dimensions permitting tactile identification of the control element.

17. A cooking appliance according to claim 16, wherein the relief has a height of at least 15 $\mu$m.

18. A cooking appliance according to claim 17, wherein the relief has a height of at least to 0.2 mm.

19. A cooking appliance according to claim 16, wherein the relief has a height less than 50 mm.

20. A cooking appliance according to claim 16, further comprising a smooth continuous transition between the relief and an area of plate surrounding the relief.

21. A cooking appliance according to claim 16, wherein the relief comprises a plurality of relief elements corresponding to a plurality of control elements, said relief elements being arranged so as to match an arrangement of a plurality of heating elements corresponding to said plurality of control elements.

22. A cooking appliance according to claim 16, wherein the relief comprises a relief element connecting said at least one control element to said at least one heating element.

23. A cooking appliance according to claim 22, wherein the connecting relief element is configured to allow control of said at least one heating element by contact with said relief element.

24. A cooking appliance according to claim 16, wherein said at least one control element comprises a sensing key.

25. A cooking appliance according to claim 24, wherein the sensing key has a substantially linear shape permitting control of a power level for said at least one heating element.

26. A cooking appliance including a glass-ceramic plate, comprising:

at least one heating element;

at least one control element configured to control said at least one heating element;

a relief formed by at least one member of the group consisting of a bump and a recess, said relief having dimensions permitting tactile identification of the control element, wherein the relief comprises a plurality of relief elements corresponding to a plurality of power levels for said at least one heating element, said relief elements having different characteristics from one another so as to allow identification of the power levels.

27. A cooking appliance according to claim 26, wherein the relief comprises a same material as the glass-ceramic plate.

28. A cooking appliance according to claim 26, wherein each of the relief elements comprises an element joined to the plate.

29. A cooking appliance according to claim 26, wherein the plurality of relief elements have different geometric shapes from each other.

30. A cooking appliance according to claim 26, wherein the plurality of relief elements have different heights from each other.

31. A process of manufacturing a glass-ceramic plate including a heating element and a control element configured to control the heating element, said process comprising the steps of:

forming the glass-ceramic plate having a top surface; and forming a relief defined by said top surface by a member of the group consisting of settling, molding and pressing said top surface, said relief being configured to permit tactile identification of the control element.

* * * * *